US011383741B2

(12) United States Patent
Kukulski et al.

(10) Patent No.: US 11,383,741 B2
(45) Date of Patent: Jul. 12, 2022

(54) FLEXIBLE CLAMP

(71) Applicant: Axtone S.A., Kanczuga (PL)

(72) Inventors: Jan Kukulski, Kosina (PL); Krzysztof Puszkarz, Przeworsk (PL)

(73) Assignee: Axtone S.A., Kanczuga (PL)

( * ) Notice: Subject to any disclaimer, the term of this patent is extended or adjusted under 35 U.S.C. 154(b) by 0 days.

(21) Appl. No.: 17/438,254

(22) PCT Filed: Mar. 26, 2020

(86) PCT No.: PCT/EP2020/058575

§ 371 (c)(1),
(2) Date: Sep. 10, 2021

(87) PCT Pub. No.: WO2020/193711

PCT Pub. Date: Oct. 1, 2020

(65) Prior Publication Data

US 2022/0041192 A1 Feb. 10, 2022

Related U.S. Application Data

(60) Provisional application No. 62/824,006, filed on Mar. 26, 2019.

(30) Foreign Application Priority Data

Mar. 26, 2019 (PL) ..... 429363

(51) Int. Cl.
*B61G 5/02* (2006.01)
*B61G 1/32* (2006.01)

(52) U.S. Cl.
CPC ..... *B61G 5/02* (2013.01); *B61G 1/32* (2013.01)

(58) Field of Classification Search
CPC ..... B61G 1/32; B61G 5/02
See application file for complete search history.

(56) References Cited

U.S. PATENT DOCUMENTS 5,507,400 A * 4/1996 Long ..... B61G 7/10 213/62 A

FOREIGN PATENT DOCUMENTS

| | | | |
|---|---|---|---|
| EP | 0520301 | A1 | 12/1992 |
| EP | 1123852 | A1 | 8/2001 |
| EP | 1884434 | A1 | 2/2008 |

OTHER PUBLICATIONS

International Search Report and Written Opinion for International Application No. PCT/EP2020/058575 dated Aug. 10, 2020, pp. 9.

* cited by examiner

*Primary Examiner* — Zachary L Kuhfuss
(74) *Attorney, Agent, or Firm* — Mannava & Kang, P.C.

(57) ABSTRACT

The invention relates to a flexible clamp for securing a pin to a base yoke in an articulated joint connection, wherein the clamp comprises a body configured for mounting to the base yoke. The body of the clamp comprises at least one recess or aperture arranged in a vicinity of the pin contact part, which is shaped and sized to control deformation of the pin contact part of the clamp, when the clamp is secured to the base and engages the pin. The invention also relates to an articulated joint connection and a railway coupler comprising the clamp according the invention.

20 Claims, 4 Drawing Sheets

FLEXIBLE CLAMP

CROSS-REFERENCE TO RELATED APPLICATIONS

The present application is a U.S. National Stage filing under 35 U.S.C. § 371 of International Application PCT/EP2020/058575, filed Mar. 26, 2020, which claims priority to U.S. Patent Application Ser. No. 62/824,006 filed on Mar. 26, 2019, and to Foreign Poland Patent Application Ser. No. P.429363 filed on Mar. 26, 2019, entitled "FLEXIBLE CLAMP".

TECHNICAL FIELD

The present application relates to a field of railway couplers, trucks, and bogies. In particular it relates to an articulated joint connection element to be used in connection of adjacent vehicle bodies.

BACKGROUND ART

Publication EP 1 884 434 discloses a typical hinge for an articulated connection of adjacent vehicle bodies of a rail vehicle, in particular in cooperation with a bogie, wherein the said hinge comprises a first joint arm having an end section on the vehicle body side connected to a base plate of the first vehicle body and a front end section having a first joint head; a second joint arm having an end section on the vehicle body side connected to a base plate of the second vehicle body and a front end section having a second joint head configured complementary to said first joint head; a joint bearing comprising a pivot pin for the articulated connection of the first and second joint heads in a joining plane, wherein the pivot pin establishes a common pivoting axis for the hinge. The pivot pin is mounted by means of clamps, which are secured in place with screws. However, when such conventional clamps are used to mount the pivot pins, there exists a problem of insufficient fit between the clamp and the base, to which the clamp is attached. This results in gaps between the surfaces of the clamp and the flat ends of the base, when the clamp is secured to the base. These gaps lead to a fatigue stress on the screws, which are used to attach the clamp to the base. This may, in turn, result in breaking off of the screws.

DISCLOSURE OF INVENTION

The inventors of the present invention have invented a flexible clamp that can be used in an articulated joint connection for joining parts of a coupler, truck, or bogie of a rail car. The clamp of the invention secures a pin to a base yoke in an articulated joint connection. The clamp of the invention comprises a body configured for mounting to the base yoke, wherein the body comprises a pin contact part extending on one side of the body and configured to engage the pin, when the clamp is mounted to the base. The clamp of the invention comprises at least one recess or at least one aperture arranged in the body in a vicinity of the pin contact part, wherein said recess is configured for deforming said body upon engagement with the pin, when the clamp is mounted to said base yoke. The shape and size, as well as location of the recess or the aperture on the body of the clamp, are determined based on a strength calculation for the clamp.

In a preferred embodiment, the body of the clamp of the invention is provided with the aperture that extends across the body from a first side to a second side of the clamp. More preferably, the clamp comprises only one aperture, which enables deformation of the clamp. Most preferably, the aperture has a kidney-shaped cross section, which corresponds to the arced shape of the pin contact part engaging with the cylindrical pin when the clamp is mounted on the base. However, the aperture or recess can have any other shape, for example, it can have a trapezoidal, circular, triangular or rectangular cross section, provided that said aperture or recess provides the clamp with the desired susceptibility to deformation or flexing of the clamp. In general, the shape and size of the recess or aperture will correspond to the form of the pin contact part and the pin engaged by the clamp. For example, in case the pin has a conical shape the recess instead of aperture can be used to provide susceptibility to deformation or flexibility of the clamp. Alternatively, the clamp of the invention can be equipped with two, three or more recesses or apertures. The susceptibility for deformation of the clamp of the invention can be therefore provided by more than one recess or aperture or their combination.

In a preferred embodiment, the clamp of the invention is flexible and it is capable of undergoing elastic deformation as the clamp is secured to the base. Thus the recess or aperture in the body of the clamp is shaped and sized to control elastic deformation of the pin contact part. Moreover, the pin contact part of the clamp flexes and works as a spring when the clamp is screwed down and secured to top flat ends of the base yoke. In order to ensure that, the pin contact part has to have slightly bigger dimensions than the pin it is to engage with. Preferably, if the pin has a cylindrical shape, the pin contact part of the clamp is in a form of a concave surface defined by a cylinder segment, wherein the radius ($r_{arc}$) of the cylinder segment constituting the pin contact part of the clamp is greater than the radius ($r_{pin}$) of the pin. More preferably, the difference between $r_{arc}$ and $r_{pin}$ is in the range of 0.05 to 5.0 mm, most preferably by 0.1 to 2.0 mm.

The body of the clamp of the invention is defined by a top surface, a bottom surface, and side surfaces extending between the top surface and the bottom surface, wherein the side surfaces include a first side surface and a second side surface located on the opposite sides of the body. The pin contact part extends across the bottom surface of the body in the direction from the first side surface towards the second side surface, and the recess or the aperture is located above the pin contact part and extends across the body in the same direction as the pin contact part. In the most preferred embodiment, the clamp is provided with the aperture that extends from the first side surface to the second side surface.

In a preferred embodiment, when the clamp of the invention in the mounted position engages with a cylindrical pin, the pin contact part thereof has a form of a concave surface constituting a segment of a cylinder surface, preferably a cylinder having a circular or elliptic base, or a segment of an ellipsoid surface. In the most preferred embodiment the pin contact part has a form of a longitudinal cylinder segment. In this embodiment the aperture located in the body of the clamp has an elongated kidney-shaped cross section, wherein the longer dimension of the cross section extends in the manner corresponding to the concave surface of the pin contact part.

The clamp of the invention is provided with the means to secure the clamp to the base. In a preferred embodiment it comprises securement holes extending across the body for receiving screws for securing the clamp to the base yoke.

However, the clamp of the invention can be secured to the base by any other suitable means.

Due to a fact that the clamp of the invention undergoes deformation when it is mounted to the base, the clamp body adheres to the flat surface of the base yoke. That way no gap is formed between the bottom surface of the clamp and the flat surface of the base yoke and no strain is exerted on the screws, which secure the clamp to the base yoke. Therefore the clamp in accordance with the present disclosure reduces or eliminates the fatigue stress on the screws used to attach the clamp to the base.

The clamp of the invention may be made of any suitable metal including steel or other iron alloys, aluminum and cast iron.

The invention also provides an articulated joint connection and a railway coupler comprising the clamp according to the invention.

BRIEF DESCRIPTION OF DRAWINGS

The subject of the invention was illustrated in a drawing, in which:

FIG. 1 presents a preferred embodiment of the flexible clamp of the invention for securing a pin 30 to a base yoke 221 in an articulated joint connection 20. The flexible clamp 10 comprises a T-shaped body 11 comprising a head part 12 and a shank part 13. The body 11 of the clamp 10 has a top surface 14 extending on the top of the head part 12 and a bottom surface 15 extending below the head part 12. The shank part 13 of the body 11 extends from the bottom surface 15 in a form of a protrusion. The side surfaces 16 defining the body 11 of the clamp 10 extend from the top surface 14 throughout the head part 12 and the shank part 13 of the body 11. The side surfaces 16 comprise a first side surface 161 and a second side surface 162 located on the opposite sides of the body 11, on the front and back of the T-shaped body 11, accordingly. These first 161 and second 162 side surfaces are parallel to each other and perpendicular to the top surface 14 of the body 11.

Figure 1:
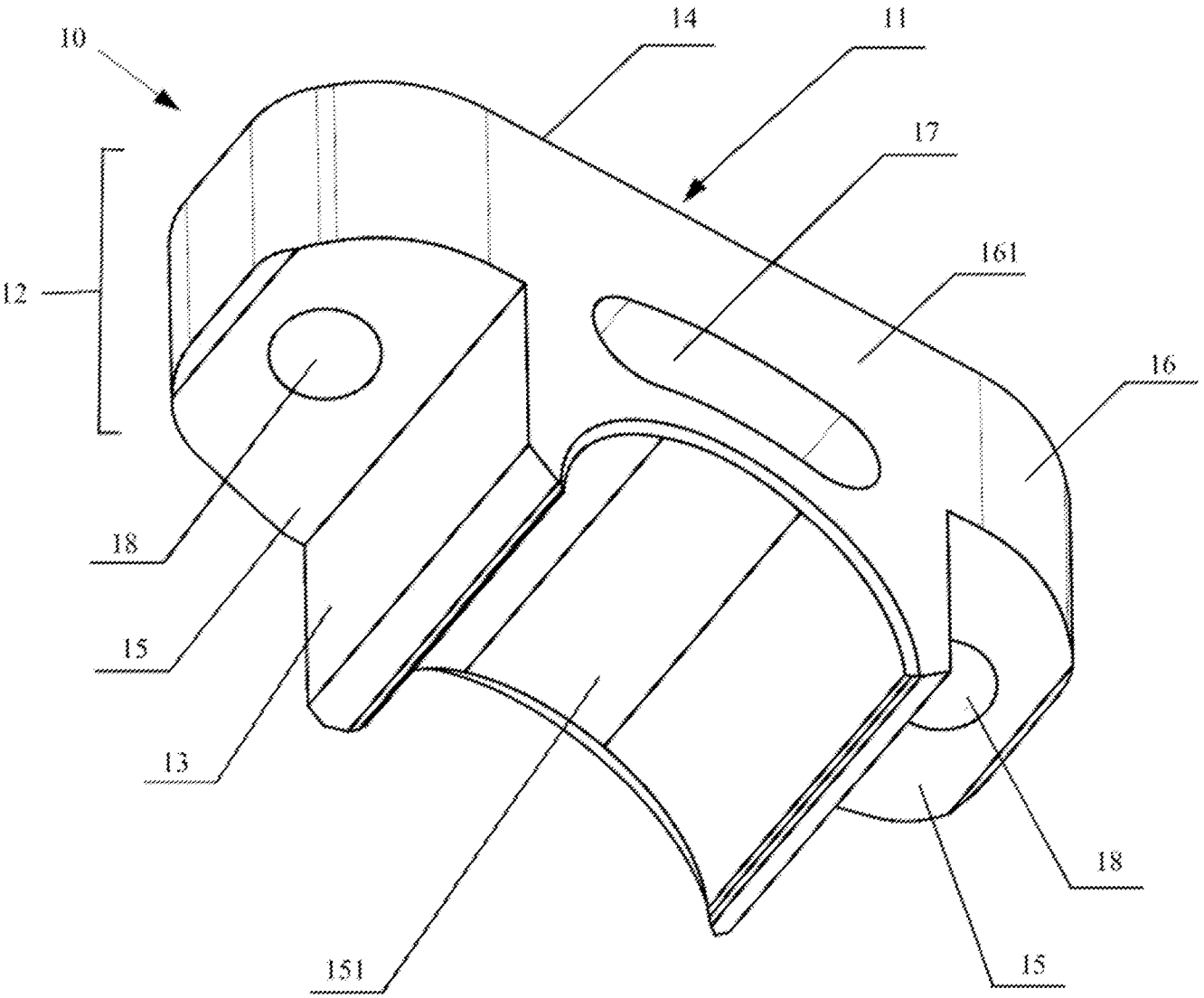
FIG. 1 shows a perspective view of the clamp according to the invention.

The body 11 of the clamp 10 is provided with a pin contact part 151 for engaging the pin 30, when the clamp 10 is secured to the base yoke 221. The pin contact part 151 has a form of a longitudinal cylinder segment (i.e. a cylindrical surface segment) extending across the shank part 13 in the direction from the first side surface 161 to the second side surface 162. In this manner the pin contact part 151 forms a concave surface (i.e. an arc), which corresponds to the cylindrical shape of the pin 30. The radius of the cylinder, a segment of which forms the pin contact part 151 of the clamp 10, is denoted in FIG. 3B as $r_{arc}$. The said cylinder is substantially coaxial with the pin 30, which is in a form of a solid cylinder. The pin contact part 151 of the clamp 10 is configured to elastically deform or flex against the pin 30 as the clamp 10 is screwed down and secured to top flat ends of the base yoke 221 with screws 40.

The body 11 is provided with one aperture 17 located above the pin contact part 151, wherein said aperture 17 extends across the body 11 of the clamp 10 from the first side surface 161 to the second side surface 162. The aperture 17 has an elongated kidney-shaped cross section, wherein the longer dimension of the cross section extends in the manner corresponding to the concave surface cross section of the pin contact part 151 (i.e. in the direction across the shank part 13 of the body). This aperture 17 allows for elastic deformation of the clamp 10 when the clamp 10 is being secured to the base yoke 221 with the screws 40. This deformation ensures that the bottom surface 15 of the head part 12 of the body 11 adheres to the flat ends of the base yoke 221. This way the strain exerted on the screws 40 connecting the clamp 10 to the base yoke 221 is eliminated.

Finally, body 11 is also provided with two securement holes 18 for receiving screws 40 for securing the clamp 10 to the base yoke 221. The securement holes 18 extend across the head part 12 of the body 11 from the top surface 14 to the bottom surface 15. The screws 40, which lock the clamp 10 in place on the base yoke 221 are inserted in the securement holes 18.

Figure 2:
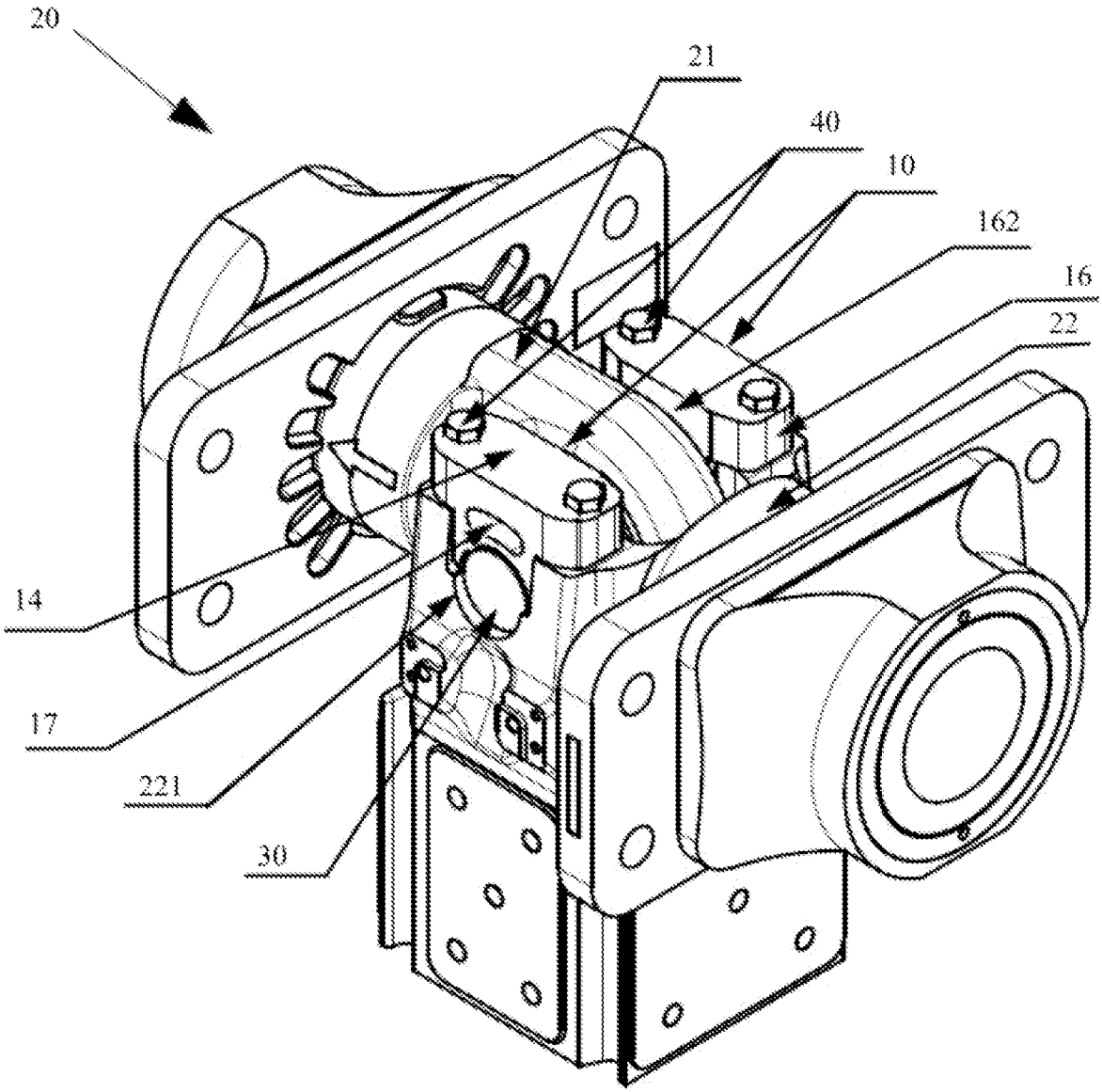
FIG. 2 shows a perspective view of the coupler comprising the clamp according to the invention.
Figure 3A:
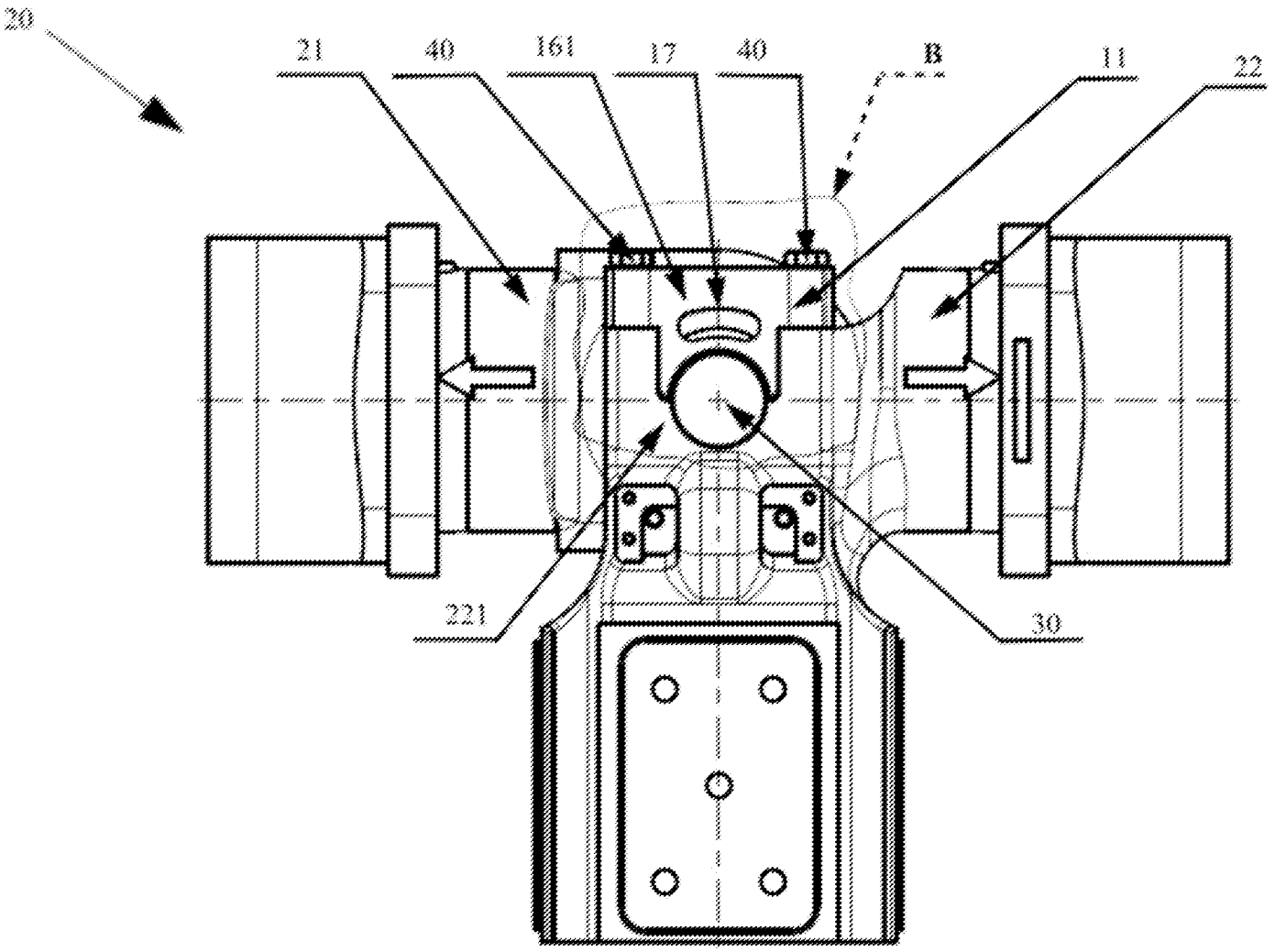
FIG. 3A shows a front view of the coupler comprising the clamp according to the present invention.
Figure 3B:
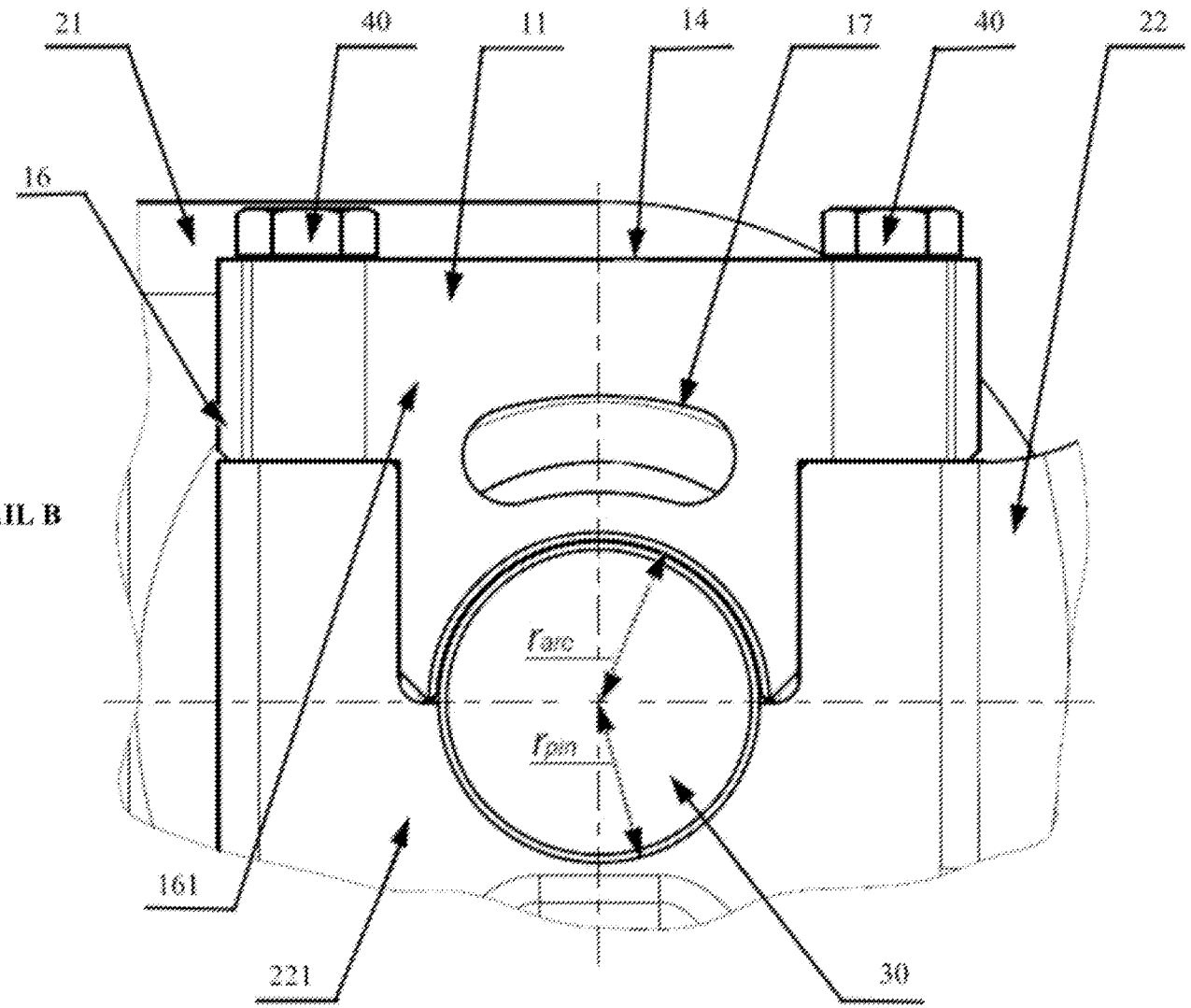
FIG. 3B presents an enlarged view of a part of the coupler (section B) comprising the clamp according to the present invention.

FIGS. 2 and 3 present a coupler 20, in which the flexible clamp 10 of the invention is used to secure the pin 30 to the base yoke 221 of a coupler 20. As shown in FIGS. 2 and 3 the pin 30, which is in a form of a solid cylinder with the radius denoted as $r_{pin}$, connects a joint between a first part 21 and a second part 22 of the coupler 20. The pin 30 is thread through an opening defined by walls of the first part 21 of the coupler 20. The first part 21 pivots axially around the pin 30. The pin 30 is secured to a curved section of a base yoke 221 of the second part 22 of the coupler 20. The pin 30 is secured to the curved sections of base yoke 221 by the clamp 10.

By providing the aperture 17 in the body 11, the clamp 10 undergoes elastic deformation while being secured to the base yoke 221 by the means of the screws 40. At the same time, the clamp material is not weakened by the presence of the aperture 17, so that the proper functioning of the clamp 10 is not affected in any way. As the clamp 10 is secured to top flat ends of the base yoke 221, the pin contact part 151 of the clamp 10 also elastically deforms or flexes against the pin 30 as the clamp 10. This deformation or flexure depends on a location, shape, and size of the aperture 17. Thus the aperture 17 is shaped and sized to control elastic deformation of the pin contact part 151 of clamp 10. Due to this deformation the bottom surface 15 of the clamp body adheres to the flat surface of the base yoke 221. That way no gap is formed between the bottom surface 15 of the clamp and the flat surface of the base yoke 221 and no strain is exerted on the screws 40, which secure the clamp 10 to the base yoke 221.

The pin contact part 151 of the clamp 10 flexes and works as a spring when the clamp 10 is screwed down and secured to top flat ends of the base yoke 221. To allow the pin contact part 151 to deform, the radius $r_{arc}$ of the cylinder, a segment of which forms the pin contact part 151, is greater than the radius $r_{pin}$ of the pin 30, wherein the difference in the radius length is in the range of 0.1 to 2 mm, as depicted by the following equation:

$$r_{arc}=r_{pin}+0.1\text{to } 2.0 \text{ mm}$$

The flexible clamp of the invention when used to secure the pin 30 to the base yoke 221 reduces or eliminates fatigue stress on the screws 40 used to attach the clamp 10 to the base yoke 221. This is achieved by securing flush the flexible clamp 10 to top flat ends of the base yoke 221 with full contact between the top flat ends of the base yoke 221 and the bottom surface 15 of the clamp body 11.

REFERENCES

10—clamp
11—body of the clamp
12—head part of the body
13—shank part of the body
14—top surface of the body
15—bottom surface of the body
151—pin contact part
16—side surfaces of the body
161—first side surface of the body
162—second side surface of the body
17—recess/aperture
18—securement hole
20—articulated joint connection/coupler
21—first part of the articulated joint connection/coupler
22—second part of the articulated joint connection/coupler
221—base yoke of the second part of the articulated joint connection/coupler
30—pin
40—screw

The invention claimed is:

1. A clamp for securing a pin to a base yoke in an articulated joint connection, the clamp comprising:
a single-piece, solid body configured to mount to the base yoke, wherein the body comprises:
a pin contact part extending on one side of the body and configured to engage with the pin,
at least one elongated recess or aperture arranged in the body in a vicinity of the pin contact part, wherein a longer dimension of the recess or aperture extends across the body in a manner corresponding to a concave surface cross section of the pin contact part and the recess or aperture is configured to deform the body upon engagement with the pin, when the clamp is mounted to the base yoke.

2. The clamp according to claim 1, wherein
the body of the clamp is defined by a top surface, a bottom surface, side surfaces extending between the top surface and the bottom surface,
the side surfaces include a first side surface and a second side surface located on the opposite sides of the body of the clamp,
the pin contact part extends across the bottom surface from the first side surface towards the second side surface, and
the recess or the aperture is located above the pin contact part and extends across the body from the first side surface in the direction of the second side surface.

3. The clamp according to claim 2, wherein the body comprises the aperture that extends from the first side surface to the second side surface.

4. The clamp according to claim 1, wherein the pin contact part has a form of a concave surface constituting a segment of a side surface of a cylinder with a circular or elliptic base, or a segment of an ellipsoid surface.

5. The clamp according to claim 4, wherein the pin contact part has a form of a longitudinal cylinder segment.

6. The clamp according to claim 4, wherein the recess or aperture has an elongated kidney-shaped cross section, and the longer dimension of the cross section extends in the manner corresponding to the concave surface of the pin contact part.

7. The clamp according to claim 4, wherein a radius ($r_{arc}$) of the segment of the side surface of the cylinder constituting the pin contact part of the clamp is greater than a radius ($r_{pin}$) of the pin accommodated by the pin contact part of the clamp.

8. The clamp according to claim 7, wherein the radius ($r_{arc}$) of the segment of the side surface of the cylinder constituting the pin contact part is greater than the radius ($r_{pin}$) of the pin by 0.05 to 5.0 mm.

9. The clamp according to claim 1, further comprising securement holes extending across the body to receive screws for securing the clamp to the base yoke.

10. An articulated joint connection comprising:
a clamp for securing a pin to a base yoke in an articulated joint connection, the clamp comprising:
a single-piece, solid body configured to mount to the base yoke, wherein the body comprises:
a pin contact part extending on one side of the body and configured to engage with the pin,
at least one elongated recess or aperture arranged in the body in a vicinity of the pin contact part, wherein a longer dimension of the recess or aperture extends across the body in a manner corresponding to a concave surface cross section of the pin contact part and the recess or aperture is configured to deform the body upon engagement with the pin, when the clamp is mounted to the base yoke.

11. The articulated joint connection according to claim 10, wherein
the body of the clamp is defined by a top surface, a bottom surface, side surfaces extending between the top surface and the bottom surface,
the side surfaces include a first side surface and a second side surface located on the opposite sides of the body of the clamp,
the pin contact part extends across the bottom surface from the first side surface towards the second side surface, and
the recess or the aperture is located above the pin contact part and extends across the body from the first side surface in the direction of the second side surface.

12. The articulated joint connection according to claim 11, wherein the body comprises the aperture that extends from the first side surface to the second side surface.

13. The articulated joint connection according to claim 10, wherein the pin contact part has a form of a concave surface constituting a segment of a side surface of a cylinder with a circular or elliptic base, or a segment of an ellipsoid surface.

14. The articulated joint connection according to claim 13, wherein the recess or aperture has an elongated kidney-shaped cross section, and the longer dimension of the cross section extends in the manner corresponding to the concave surface of the pin contact part.

15. The articulated joint connection according to claim 13, wherein a radius ($r_{arc}$) of the segment of the side surface of the cylinder constituting the pin contact part of the clamp is greater than a radius ($r_{pin}$) of the pin accommodated by the pin contact part of the clamp.

16. The articulated joint connection according to claim 10, further comprising securement holes extending across the body to receive screws for securing the clamp to the base yoke.

17. A railway coupler comprising:
a clamp for securing a pin to a base yoke in an articulated joint connection, the clamp comprising:

a single-piece, solid body configured to mount to the base yoke, wherein the body comprises:

a pin contact part extending on one side of the body and configured to engage with the pin, at least one elongated recess or aperture arranged in the body in a vicinity of the pin contact part, wherein a longer dimension of the recess or aperture extends across the body in a manner corresponding to a concave surface cross section of the pin contact part and the recess or aperture is configured to deform the body upon engagement with the pin, when the clamp is mounted to the base yoke.

18. The railway coupler according to claim 17, wherein the body of the clamp is defined by a top surface, a bottom surface, side surfaces extending between the top surface and the bottom surface, the side surfaces include a first side surface and a second side surface located on the opposite sides of the body of the clamp, the pin contact part extends across the bottom surface from the first side surface towards the second side surface, and the recess or the aperture is located above the pin contact part and extends across the body from the first side surface in the direction of the second side surface.

19. The railway coupler according to claim 18, wherein the body comprises the aperture that extends from the first side surface to the second side surface.

20. The railway coupler according to claim 17, wherein the pin contact part has a form of a concave surface constituting a segment of a side surface of a cylinder with a circular or elliptic base, or a segment of an ellipsoid surface.

* * * * *